US005658360A

United States Patent [19]

Keil

[11] Patent Number: 5,658,360

[45] Date of Patent: Aug. 19, 1997

[54] COMPRESSION MOLDING OF ABRASIVE ARTICLES USING WATER AS A TEMPORARY BINDER

[75] Inventor: Elinor B. Keil, Worcester, Mass.

[73] Assignee: Norton Company, Worcester, Mass.

[21] Appl. No.: 510,246

[22] Filed: Aug. 2, 1995

[51] Int. Cl.[6] ..... C09K 3/14

[52] U.S. Cl. ..... 51/298; 264/234; 264/319

[58] Field of Search ..... 264/234, 236, 264/319, 325; 51/298

[56] References Cited

U.S. PATENT DOCUMENTS

| | | | |
|---|---|---|---|
| 3,619,151 | 11/1971 | Sheet, Jr. et al. | 51/307 |
| 3,878,160 | 4/1975 | Grazen et al. | 260/38 |
| 4,264,557 | 4/1981 | Annis | 264/328.1 |
| 4,617,165 | 10/1986 | Tsang et al. | 264/236 |
| 4,918,116 | 4/1990 | Gardziella et al. | 523/149 |
| 5,089,032 | 2/1992 | Moran | 51/293 |
| 5,131,923 | 7/1992 | Hay et al. | 51/293 |
| 5,135,892 | 8/1992 | Zandi et al. | 501/1 |
| 5,236,472 | 8/1993 | Kirk et al. | 51/298 |
| 5,399,606 | 3/1995 | Konig et al. | 524/385 |
| 5,403,791 | 4/1995 | Minami | 501/94 |
| 5,470,368 | 11/1995 | Culler | 51/298 |
| 5,549,719 | 8/1996 | Lee et al. | 51/298 |
| 5,556,437 | 9/1996 | Lee et al. | 51/298 |

OTHER PUBLICATIONS

J.F. Monk; Thermosetting Plastics, Chapter 3; "Compression Moulding of Thermosetting Materials"; pp. 41/71.

Kirk–Othmer Encyclopedia of Chemical Technology, Third Edition, vol. 17; "Phenolic Resins"; pp. 384/416.

Bakelite$^R$publication; "Rutaphen$^R$ —Resins for Grinding Wheels—Technical Information" (KN 50E–09.92–G&S–BA).

Bakelite$^R$publication: "Rutaphen$^R$Phenolic Resins—Guide/Product Ranges/Application" (KN107/e–10.89 GS–BG) pp. 80/81.

*Primary Examiner*—Donald E. Czaja
*Assistant Examiner*—Jacqueline A. Ruller
*Attorney, Agent, or Firm*—Mary E. Porter

[57] ABSTRACT

Uncured molded abrasive articles having low volatile organic chemical content are prepared using water as a temporary binder. The abrasive articles preferably contain a uniformly coated abrasive grain comprising a novolac resin having a phenol:formaldehyde ratio of 1:0.2 to 1:0.35 and containing less than 0.5% free phenol.

5 Claims, No Drawings

COMPRESSION MOLDING OF ABRASIVE ARTICLES USING WATER AS A TEMPORARY BINDER

This invention relates to the use of water as a temporary binder in the manufacture of abrasive articles by compression molding techniques.

BACKGROUND OF THE INVENTION

Resin-bonded abrasive articles such as grinding wheels are typically produced by blending discrete abrasive grain or grit particles with a liquid resin material and a powdered resin, and then pressing the mixture under appropriate thermal conditions. Other constituents can be included in the mixtures, e.g., fillers, curing agents, wetting agents, and various metal powders. An aging period which allows for solvation of the dry portion of the mixture with the liquid resin is usually required before pressing.

In the manufacture of abrasive articles it is necessary to bind the abrasive grain particles together so that the article may be molded and otherwise handled prior to the curing process. Heat is applied during the curing process to fix the article into the desired shape. The ideal temporary binder provides green strength to the uncured abrasive article, provides flexibility in scheduling of manufacturing, i.e., no aging step is needed; is useful in either a compression molding (cold press) or hot press operation, and does not cause irreversible agglomeration of the abrasive grain when the grain is stored prior to molding of the abrasive article. Green strength is important both in the removal of an uncured abrasive article from the mold and transfer of the article to facilities for curing the abrasive article, and in maintaining the integrity of the desired shape, particularly in precision grinding wheels.

As noted in U.S. Pat. No. 4,918,116 (Gardziella et al), phenol novolac resins have been used in organic solvent solutions for bonding abrasive articles. No temporary binder is needed prior to cure. Disadvantages of such a system include the easy ignitability of the solvents at high temperatures and waste disposal. While solvent-free modified novolac resins have been developed, these materials are quite expensive.

In addition to the difficulties involved with using certain phenol-novolac binders for making abrasive articles, manufacturers are sometimes faced with other production problems as well. For example, the use of liquid grain wetting agents such as liquid phenolic resin when preparing molding materials for abrasive wheels may result in an unstable molding mixture. Furthermore, the use of such a mixture may generate a large amount of dust, often a drawback on the manufacturing floor.

The dust and stability problems associated with using novolac binders appears to have been somewhat alleviated by the teachings set forth in Gardziella. This reference discloses the preparation of various molding materials, using specific phenol-novolac resins having a phenol-formaldehyde molar ratio of 1:0.2 to 1:0.35. As an example, abrasive discs are prepared by using heated corundum grains wetted with a hot melt of the specified phenol-novolac resins. After being blended at 140° C. in a high-power mixer, the composition is cooled to 90° C. and then further blended with a second novolac resin and a curing agent.

Gardziella limits his comments to "the high-temperature resistance molding materials for the production of hot-pressed abrasive discs." He does not address the cold pressing of abrasive articles. Based on other teachings in the art, presumably an organic binder, such as furfural, would be used as a temporary binder in cold pressing to permit molding and handling of the uncured abrasive article. In the past, organic solvents and other organic materials, such as furfural and alcohols which are compatible with phenolic resins and with rubber materials used to provide more flexible resins in abrasive articles, have been used as temporary binders.

Due to the increased attention given to environmental concerns, the use of organic solvents or other organic materials as temporary binders creates difficulties in manufacturing. Organic binders are undesirable in the air, water and solid waste effluent streams. They contribute to the volatile organic chemical content of the uncured abrasive article and, possibly, the cured article; to additional inventory controls required for organic solvents; and to landfill concerns arising from the disposal of used abrasive articles, such as wheel stubs. Organic materials tend to leach out of the used abrasive articles in landfills, thereby creating potential ground water contamination, soil contamination and other environmental and regulatory concerns.

Some environmental concerns are alleviated by the use of the phenol-novolac resin of the sort taught by Gardziella. In particular, these resins are characterized by an exceptionally low free phenol content, in the order of less than 0.5%.

It has now been discovered that water, an environmentally friendly solvent, is an excellent temporary binder for phenolic resin coated abrasive grain. Water provides excellent green strength to the uncured abrasive article, is useful in cold pressing operations, permits the reuse of abrasive grain mixtures and flexibility in manufacturing operations, and is entirely free of environmental concerns. The use of water as a temporary binder is particularly beneficial when done in combination with a low volatile organic chemical content resin, such as the phenol-novolac resin of Gardziella.

Furthermore, the final article must retain its functional properties. In the case of an abrasive wheel, the desirable properties include grindability and long working life. Water used as a temporary binder has no adverse effects on the final abrasive article.

SUMMARY OF THE INVENTION

This invention provides an uncured, molded abrasive article comprising:

a. a granular abrasive material uniformly coated with at least one phenol-novolac resin;

b. an effective amount of at least one curing agent; and c. an amount of water effective to bind the abrasive article prior to curing;

wherein the abrasive article comprises less than 0.5%, by weight, volatile organic chemicals.

This invention also provides a process for preparing a molded abrasive article, comprising the steps:

a. preblending at 80° to 130° C. a liquid phenol-novolac resin having a viscosity of 300 to 3,000 cp with a granular abrasive material until a uniformly coated abrasive grain is formed;

b. blending the uniformly coated abrasive grain with abrasive article components comprising at least one curing agent and at least one dry phenol-novolac resin to form a free flowing uniformly coated abrasive grain;

c. mixing an effective amount of water with the free flowing uniformly coated abrasive grain to form a free-flowing, compressible mixture;

d. placing the free-flowing compressible mixture into a mold having a desired shape configuration; and e. pressing the free-flowing compressible mixture at a temperature less than 40° C. until an uncured molded abrasive article is obtained, wherein the uncured molded abrasive article has sufficient green strength to be removed intact from the mold and heat cured without loss of the desired shape configuration.

DETAILED DESCRIPTION OF THE INVENTION

An uncured, molded abrasive article is prepared with an amount of water effective to temporarily bind the abrasive article prior to curing. Benefits of water as a temporary binder in uncured molded abrasive articles are particularly notable when the water is used to bind granular abrasive materials which have been uniformly coated with at least one novolac resin. It is preferred that the resin contain less than 0.5%, by weight, free phenol, and be substantially free of volatile organic chemicals. Such a resin may be used to prepare an uncured abrasive article typically comprising less than 0.3, preferably less than 0.2%, by weight, free phenol.

In a preferred embodiment, water is used as a temporary binder in the amount of 0.001 to 5%, by weight of the uniformly coated abrasive grain. Water in the amount of 0.5 to 3%, by weight of the uniformly coated abrasive grain, is most preferred.

To achieve the full environmental benefit of the invention, it is preferred that the uncured abrasive article contain less than 0.5%, by weight, volatile organic chemicals. Following cure of the abrasive article at (e.g., 120° C.–175° C. for 2–18 hours) the cured abrasive article is preferably substantially free of volatile organic chemicals.

In a preferred embodiment, following cure, the abrasive article comprises, on a weight percentage basis, 60 to 80% granular abrasive material, 5 to 10% novolac resin, 0 to 2.0% curing agent, 0 to 30% filler, and 0 to 5% metal oxide. The cured abrasive article comprises less than about 0.3%, by weight, free phenol and less than about 0.5%, by weight, volatile organic chemicals. Although the benefits of using water as a temporary binder for green strength and mix handling are most noticeable in the processing of soft grade wheels (e.g., having a porosity of 30 to 40%, by volume), benefits are also observed in the harder grade wheels having lower porosity (e.g., less than 12% porosity).

The abrasive mix components, the batch size and the storage or holding requirements for the mix will affect the optimum amount of water which is useful as a temporary binder.

Although the preferred embodiment of the invention employs a uniformly coated abrasive grain which has been prepared as described below, a minor amount of an uncoated abrasive grain may be combined with the coated grain and other components in the uncured abrasive articles of the invention. It is preferred that no more than 20% preferably 10 to 15%, by weight, of uncoated abrasive grain be used in the mix formulation.

Continuous blending of the abrasive material with liquid and dry novolac resins is preferred. As used in regard to the initial steps of an overall process for preparing abrasive articles, "continuous blending" means applying the material of each component to the abrasive grains without substantial interruption. As an example, liquid and dry resin components are preferably delivered to the mixer simultaneously. This technique is to be contrasted with methods used in the past, which involved batch mixing, i.e., blending a portion of liquid resin component with a portion of dry resin component, followed by an additional portion of liquid resin and an additional portion of dry resin, and so forth. The curing agent of this invention, can be delivered to the mixer at any appropriate time, before or during addition of the other ingredients, but is preferably preblended with the dry resin component.

The granular abrasive material used for this invention may be a conventional abrasive or a superabrasive. Conventional abrasives include, for example, aluminum oxide, silicon carbide, zirconia-alumina, garnet, emery, and flint. Superabrasives include diamond, cubic boron nitride (CBN), and boron suboxide (described in U.S. Pat. No. 5,135,892 which is hereby incorporated by reference). Various mixtures of abrasive materials are also contemplated, e.g., a mixture of aluminum oxide and zirconia alumina. The total amount of abrasive material employed is about 40 to about 70 volume % of any cured abrasive body prepared as described herein.

The average particle size of grains (sometimes referred to as "grits") of the abrasive material depends on a variety of factors, such as the particular abrasive utilized, as well as the end use of tools formed from the abrasive body. In general, an average particle size for superabrasives and conventional abrasives is in the range of about 0.5 to about 5000 micrometers, and preferably, in the range of about 2 to 200 micrometers. An appropriate abrasive particle size for a desired application may be selected without undue experimentation.

In a preferred embodiment, this invention includes a sol-gel-derived abrasive. Examples of these abrasives are the sol-gel alumina abrasive grits, which can be seeded or unseeded. These types of materials are described, for example, in U.S. Pat. No. 5,131,923, incorporated herein by reference.

The abrasive material may be used at room temperature. However, it is preferably preheated before blending begins, e.g., to a temperature in the range of about 30° C. to about 150° C. In especially preferred embodiments, the temperature difference is within about 25° C. of that of the liquid novolac resin. This matching of material temperature will minimize viscosity changes which occur when heated resinous material contacts colder or hotter abrasive particles.

A preferred liquid novolac resin is described in U.S. Pat. No. 4,918,116 (Gardziella), which is hereby incorporated by reference. As described in Gardziella, this resin has a phenol-formaldehyde molar ratio in the range of 1:0.2 to 1:0.35. The resin usually has a content of free phenol of less than about 0.5%. These resins also have a very high adhesive holding power, giving very free-flowing resin coated abrasive granules for molding. An additional attribute of the resin coated abrasive granules is their stability, which guarantees long storage life.

The preferred molecular weight of these materials for the purpose of the present invention is in the range of about 200 to about 1000, weight average.

The novolac resins are solid at room temperature, and begin to melt above 25° C. At 70° C., they have a relatively low melting viscosity, making them easy to handle and blend with the other components. The low melting viscosity obviates the need for solvents during the blending step. They are preferably preheated to a temperature sufficient to yield a viscosity in the range of about 300 cp to about 3000 cp before being delivered to the mixer. The preferred viscosity lies in the range of about 400 cp to about 800 cp, which corresponds to a temperature of about 125° C. to about 115° C.

The second novolac resin is used as a dry powder. The nature of this resin is not critical, although its phenol-formaldehyde ratio preferably lies outside of the ratio of the liquid novolac resin. It can, for example, be one of the materials generally described in the *Kirk-Othmer Encyclopedia* of Chemical Technology, Third Edition, Volume 17, pages 384 to 416, the contents of which are incorporated herein by reference. Suitable phenol novolacs are also described in U.S. Pat. Nos. 4,264,557 (Annis) and 3,878,160 (Grazen et al), both incorporated herein by reference.

In this invention, the dry novolac resin will typically have a phenol-formaldehyde molar ratio in the range of about 1:0.5 to about 1:0.9. The dry resin preferably has a free phenol content of less than about 5.0%,most preferably less than 1.0% by weight. These materials are solid at room temperature, and begin to melt above about 70° C. However, these materials are delivered to the mixer as solids, i.e., below their melting point. Preferably, they are used at room temperature, in the form of a powdery mix with some of the optional constituents described below.

The preferred molecular weight of the dry novolac resin is in the range of about 2,000 to about 15,000. An especially preferred molecular weight range is usually about 5,000 to about 12,000.

In regard to the relative amounts of novolac resins used herein, the weight ratio of liquid resin to dry resin, excluding other ingredients, is usually in the range of about 7:1 to about 1:7. An especially preferred ratio is about 3:1 to about 1:3.

The dry novolac resin may be preblended with all or a portion of the curing agent. The curing agent usually constitutes about 0.1% to 20% by weight, and preferably about 7% to 14% by weight, of the total weight of novolac resins to be included in the molding material.

A wide variety of fillers can be included. Nonlimiting examples of suitable fillers are sand, silicon carbide, alumina, bauxite, chromites, magnesite, dolomites, mullite, silica alumina ceramic (e.g., Zeolite® filler) borides, fumed silica, sol gel materials, titanium dioxide, carbon products (e.g., carbon black, coke, or graphite); corundum, wood flour, clay, talc, calcium fluorospar, hexagonal boron nitride, molybdenum disulfide, zirconia, and various forms of glass, such as glass fiber. Mixtures of more than one filler are also possible.

The effective amount for each filler or combination of fillers can be determined by those of ordinary skill in the art. The usual level of fillers for this invention is 0 to about 30 parts by weight, based on the weight of the entire composition. In the case of abrasive discs, the level of filler material is usually in the range of about 5 to 20 parts by weight, based on the weight of the disc.

The dry novolac resin component may include other ingredients typically employed in making abrasive articles. Notable examples include antistatic agents; metal oxides such as lime, zinc oxide, magnesium oxide, and mixtures thereof; and lubricants such as stearic acid, glycerol monostearate, graphite, carbon, molybdenum disulfite, wax beads, and calcium fluroride. As in the case of fillers, the appropriate amount of each of these materials can readily be determined by those skilled in the art.

Curing agents suitable for use herein are described, for example, in the above-mentioned patent of Grazen et al. Various amines may be used, such as ethylene diamine; ethylene triamine; methyl amines; and hexamethylene tetramine ("hexa"). Precursors of such materials may also be used. As an example, ammonium hydroxide is a suitable curing agent because it reacts with formaldehyde to form hexa. Hexa and its precursors are the preferred curing agents.

Effective amounts of the curing agent, usually, about 5 to about 20 parts (by weight) of curing agent per 100 parts of total novolac resin, are employed. Those of ordinary skill in the area of resin-bound abrasive articles will be able to adjust this level, based on various factors, e.g., the particular types of resins used; the degree of cure needed, and the desired final properties for the articles: strength, hardness, and grinding performance. In the preparation of abrasive wheels, an especially preferred level of curing agent is about 8 parts to about 15 parts by weight.

Various mixers may be used to blend the abrasive material with the other components described above. Examples of suitable mixers are the Eirich (e.g., model RV02) and Littleford types, as well as a bowl-type mixer. The best results in terms of abrasive grain quality are usually achieved by using a low power mixer. Low power also prevents excessive part wear, as compared to wear characteristics when a higher power mixer is employed.

As an illustration of low power operation, the Eirich model mentioned above should be used at a slow pan speed, usually less than about 65 rpm, with a mixing agitator speed of less than about 2,000 rpm.

Bowl-type mixers are preferred. For this invention, these types of mixers are also operated at relatively low power, e.g., a pan speed of less than about 50 rpm. The bowl-type mixers often include one or more sets of paddles, which for this invention preferably operate at a speed of less than about 200 rpm. In the most preferred embodiments, the paddles operate at a speed of less than about 150 rpm.

As mentioned above, the continuous blending of abrasive (already situated in the mixer, and usually preheated) with liquid and dry resin components usually requires the simultaneous delivery of each component. Simultaneous addition readily permits the abrasive grains to become homogeneously coated with each component, as described below. The relative amount of each component being delivered to the mixer is measured so that the proportion of each component to the other during delivery is as constant as possible.

Blending times depend on a variety of factors related to processing and materials, e.g., the type of abrasive and binder resins employed, the presence or absence of fillers; the type and capacity of mixer equipment used; the quantities of materials being processed, etc. In general, blending time will range from about 3 minutes to about 6 minutes for a smaller scale of processing, e.g., 50 pounds total material; and from about 3 minutes to about 8 minutes for a larger-scale situation, e.g., up to about 600 pounds total material. Those of ordinary skill in abrasives processing will be able to select the most appropriate blending time, based in part on the teachings herein.

As mentioned above, the blending temperature during and after addition of the various components is usually in the range of about 80° C. to about 130° C. Preferably, the blending temperature is in the range of about 90° C. to about 125° C. The temperature tends to decrease during the blending process for several reasons. First, the blending system is usually open to the atmosphere, with a consequent loss of heat. Second, the dry resin is usually delivered to the mixer at room temperature. Thus, the final temperature of the mixture after blending is complete is usually in the range of about 65° C. to 90° C. The temperature drop is beneficial in some respects, since it tends to inhibit premature cure and agglomeration of the abrasive/resin system.

After blending is complete, the molding material can be stored for later use. It is a dry, flowable granular material upon cooling to ambient temperature. Furthermore, the granules are substantially dust-free, in comparison to some molding materials prepared with volatile organic materials.

After completion of the above-described process, the abrasive grains in the present invention are homogeneously coated with the novolac resins. This uniform coating is demonstrated by examination of the grains. The absence of significant regions where dry bond (i.e., fillers and dry resin) is excessively concentrated is apparent. Similarly, the absence of significant tacky, "liquid resin-rich" regions is noted.

Homogeneity is further demonstrated by a reduced amount of "loose material", i.e., material which does not adhere to the abrasive grains and can cause significant processing complications. The total amount of dry bond which does not adhere to the abrasive grains after the blending step should be less than about 3% by weight, based on the total weight of the molding material. In preferred embodiments, the amount is less than about 1.5%. In especially preferred embodiments, e.g., where the molding material is to be used for the preparation of high performance abrasive discs, the amount of this non-adherent material should be less than about 0.5%.

Another important attribute of a molding material prepared by the present process is its storage stability. Unlike prior art compositions which contained a higher level of volatile organic constituents, (e.g., free phenol) these molding materials generally do not undergo physical or chemical change due to evaporation over a period of time. As an example, a 600 pound sample can be stored at room temperature for at least 3 months, and then pressed and cured to form an abrasive article which has the same characteristics as an article prepared with a "freshly-blended" molding material.

Instead of being stored, the molding material can be used immediately to prepare the abrasive articles of interest. It is usually first passed through a screen to remove any agglomerates, and then conveyed directly to molding equipment. Thus, in preferred embodiments, there is no aging step between blending and molding, unlike most of the processes of the prior art. Since an aging step can be costly and time-consuming, elimination of such a step is a considerable advantage from a commercial point of view.

Water may be added to the molding material to form a free flowing compressible mixture by any means known in the art. Preferred means of adding the water are spraying and other slow addition techniques with continuous mixing. Where appropriate in a given mix formulation, other binder materials may be added to the water (e.g., dextrin, glycerol or sugars), as well as mix adjuncts which need to be uniformly dispersed throughout the abrasive article.

The water binder must be thoroughly mixed with the other abrasive article components. Mixing may be carried out as described above, or by any technique known in the art of manufacture of abrasive articles.

Although aging of the mix containing water as a binder is not necessary to achieve good mix handling or green strength, additional green strength is achieved upon aging of the molded article made from the mix. In particular, aging from 2 to 10 hours results in improved green strength of the uncured abrasive article.

Where necessary under manufacturing conditions, the mix containing water as a binder may be permitted to dry by evaporation under ambient conditions and subsequently be reused without the need for extensive mixing, screening of agglomerates, and other techniques used in the art for recovery of mixes containing organic binders, such as furfural. Thus, mixes may be stored both before and after the addition of water as a binder.

The mix of molding materials may be pressed by any of the techniques known in the art.

Hot pressing, warm pressing, or cold pressing may be utilized. Hot pressing is described, for example, in a Bakelite© publication, *Rutaphen©-Resins for Grinding Wheels— Technical Information*. (KN 50E-09.92-G&S-BA), and in Another Bakelite© publication: *Rutaphen© Phenolic Resins— Guide/Product Ranges/Application* (KN107/e-10.89 GS-BG), both of which are incorporated herein by reference. Useful information can also be found in *Thermosetting Plastics*, edited by J. F. Monk, Chapter 3 ("Compression Moulding of Thermosets"), 1981 George Goodwin Ltd. in association with The Plastics and Rubber Institute. This publication is also incorporated herein by reference. To illustrate, an abrasive disc or grinding wheel can be prepared by placing the blended material in an appropriate mold, usually made of stainless-, high carbon-, or high chrome-steel. Shaped plungers may be employed to cap off the mixture. Cold preliminary pressing is sometimes used, followed by preheating after the loaded mold assembly has been placed in an appropriate furnace. The mold assembly can be heated by any convenient method: electricity, steam, pressurized hot water, or gas flame. A resistance- or induction-type heater is usually employed. An inert gas like nitrogen may be introduced to minimize oxidation of the mold.

The specific temperature, pressure and time ranges will depend on the specific materials employed, the type of equipment in use, and the dimensions of the wheel. The molding pressure usually ranges from about 0.5 tsi to about 5.0 tsi, and preferably, from about 0.5 tsi to about 2.0 tsi. The pressing temperature for this process is typically in the range of about 115° C. to about 200° C.; and preferably, from about 140° C. to about 170° C. The holding time within the mold is usually about 30 to about 60 seconds per millimeter of abrasive article thickness.

For the purpose of this disclosure, the scope of the term "hot pressing" includes hot coining procedures, which are known in the art. In a typical hot coining procedure, pressure is applied to the mold assembly after it is taken out of the heating furnace.

Cold pressing and warm pressing are preferred techniques, especially in manufacturing operations where energy- and time-conservation requirements are critical. Cold pressing is described in U.S. Pat. No. 3,619,151, which is hereby incorporated by reference. A predetermined, weighed charge of the blended composition is initially delivered to and evenly distributed within the cavity of a suitable mold, e.g., a conventional grinding wheel mold. The material remains at ambient temperature, usually less than about 40° C. and preferably less than about 30° C. Pressure is then applied to the uncured mass of material by suitable means, such as a hydraulic press. The pressure applied will be in the range of about 0.5 tsi to about 15 tsi, and more preferably, in the range of about 1 tsi to about 6 tsi. The holding time within the press will usually be in the range of about 5 seconds to about 1 minute. It appears that the compacting pressure necessary for favorable results can be reduced up to about 20% by the use of lubricant-type materials such as graphite and stearates.

Warm pressing is a technique very similar to cold pressing, except that the temperature of the blended mix in the mold is elevated, usually to some degree below about 140° C., and more often, below about 100° C. The same general pressure and holding time parameters followed for cold pressing are followed here.

After either cold or warm pressing, the molded material is cured. Selection of a curing temperature depends on at least several factors, including the strength, hardness, and grinding performance desired for the particular abrasive article. Usually, the curing temperature will be in the range of about 150° C. to about 250° C. In more preferred embodiments, the curing temperature will be in the range of about 150° C. to about 200° C. Curing time will range from about 6 hours to about 48 hours. In many instances, the final curing temperature is reached in steps, i.e., passing through intermediate temperatures and holding periods. In a preferred embodiment the molded abrasive article is heated to 120° for 2 to 3 hours and then to 175° for 12 to 18 hours in air at atmospheric pressure. Such a technique enhances additional wetting of the dry components in the mixture with the liquid components.

After pressing and curing, the abrasive articles are stripped from the mold and air-cooled. Subsequent steps are also possible, e.g., the edging and finishing of abrasive wheels, according to standard practice. For this invention, the porosity of the molded article after curing is usually in the range of about 0 to 60%, and most often, in the range of about 4 to 40% by volume. Cold pressed cured articles preferably comprise about 12 to 60%, most preferably about 20 to 40%, by volume, porosity.

The following examples further illustrate various aspects of this invention, without limitation. All parts and percentages are by weight, unless otherwise indicated.

EXAMPLE 1

4636 g of aluminum oxide abrasive of grit sizes 20 and 30 (1:1 ratio) and 7861 g of zirconia-alumina abrasive of grit size 24 were preheated to 120° C. and placed in a mixing bowl of 51 cm diameter. 898 g of the low-molecular weight liquid novolac resin (phenol:formaldehyde ratio of 1:0.2 to 1:0.35), heated to 120° C., were slowly added to the mixer simultaneously with 4649 g of preblended, dry material (material at room temperature) consisting of 1792 g novolac resin, 1487 g iron pyrite, 835 g potassium sulfate, 387 g calcium oxide, and 145 g hexamethylenetetramine. During the mixing cycle, the bowl was rotating clockwise at 30 rpm. One set of agitator blades was rotating clockwise at 80 rpm, and another rake-like agitator was rotating counterclockwise at 110 rpm. Following a total mixing time of 6 minutes, the mixture temperature was at 75° C. The mixture at this point consisted of dry, flowable (resin/filler uniformly coated abrasive) granules with less than 1% loose material.

EXAMPLE 2A

Uniformly coated granular abrasive material was prepared by preheating 2,072 g of an alumina (36 grit) to a temperature in the range of about 80° C. to about 120° C. The blend was then placed in a mixing bowl of 25 cm diameter, similar to that used for Example 1. A total of 26 g of a low molecular weight novolac resin (phenol-formaldehyde molar ratio of 1:0.2 to 1:0.35) was used. This material was preheated to a temperature sufficient to attain a viscosity of about 400 cp to 800 cp (i.e., a temperature in the range of about 115° C.–125° C.). A total of 169 g of a pre-blended dry bonding material containing 153.8 g standard novolac resin material, and 15.2 g hexamethylenetetramine was used. The liquid resin and dry bonding materials were layered onto the abrasive grains in a series of three steps, with each step utilizing about one-third of the total amount of each component. Mixing parameters were similar to those used for Example 1, with a mixing temperature of about 120° C.

The resulting dry, flowable product contained only 0.4% volatiles as determined by thermogravimetric analysis.

EXAMPLE 2B

Uniformly coated granular abrasive material was prepared by preheating 16,438.7 g of an abrasive blend of alumina and silicon carbide (36 grit) to a temperature in the range of about 80° C. to about 120° C. The blend was then placed in a mixing bowl of 51 cm diameter, similar to that used for Example 1. A total of 372 g of a low molecular weight novolac resin (phenol-formaldehyde molar ratio of 1:0.2 to 1:0.35) was used. This material was preheated to a temperature sufficient to attain a viscosity of about 400 cp to 800 cp (i.e., a temperature in the range of about 115° C.–125° C.). A total of 1333.3 g of a pre-blended dry bonding material containing 1213.3 g standard novolac resin material, and 120.0 gmhexamethylenetetramine was used. The liquid resin and dry bonding materials were layered onto the abrasive grains in a series of three steps, with each step utilizing about one-third of the total amount of each component. Mixing parameters were similar to those used for Example 1, with a mixing temperature of about 120° C.

EXAMPLE 3

Using water as a temporary binder, the coated granular abrasive materials of Example 2A were mixed in the amounts shown in Table 1, below, to form free-flowing compressible grain mixtures. Control samples containing (1) no binder and (2) furfural as a binder were prepared in amounts shown in Table 1. The grain mixtures of the invention (74.8 g of moist mix) and the controls (74.8 g of mix) were used to compression mold 10.16 cm×2.54 cm×1.77 cm (4"×1"×1½") uncured molded abrasive articles (bars) at room temperature and at a pressure of 703 kg/sq. cm. (5 tons per square inch) in a laboratory scale press.

Results are shown in Table 1.

TABLE 1

| | COMPONENT | | | |
|---|---|---|---|---|
| | Coated Granular Abrasive (g) | Binder (ml) | Mix Handling | Uncured Molded Article |
| Water Binder | 200 | 2 | Good | Excellent green strength |
| | 100 | 1 | Good | |
| | 100 | 2 | Good | Excellent green strength |
| | 100 | 4 | Excellent (cling and flow Optimum) | Excellent green strength |
| | | | | Excellent green strength |
| No Binder | 100 | 0 | Good | No green strength, bar fell apart[a] |
| Furfural Binder | 400 | 1 | Good (Dried upon standing) odor | Little green strength, tacky, crumbly bar, odor |
| | 326 | 2 | Tacky, odor, wet mix dried upon standing | Little green strength, tacky, crumbly bar, odor |

[a]The mold closed, but sprung open when pressure was released.

The results show that addition of 1 to 4% water as a temporary binder significantly improved the green strength and mix handling properties during preparation of uncured abrasive bars. The samples were successfully "cold" pressed at room temperature and demonstrated shape integrity (size and profile) following cure (at 60° to 120° C. for 40 minutes; 120° C. for 2 hours; 120° to 175° C. for 3 hours, and 175° C. for 20 minutes).

In load displacement measurements made on a molded article during compression molding the materials containing water as a binder exhibited a very sharp displacement peak relative to the material containing furfural and with a loading 2 –5 times that of furfural. The material with no binder fell apart on handling, hence load displacement could not be measured. Thus, the water binder yielded the best mix for cold pressing operations.

While no aging of the mix containing water binder was needed for mix handling or green strength, aging studies showed improved green strength of uncured abrasive bars made from mix aged 2 to 10 hours.

EXAMPLE 4

Abrasive wheels were fabricated with either water or tridecylalcohol (TDA) as a temporary binder during mix handling and molding steps.

Abrasive grain mix was blended as described in Example 1. Portions (450 g) of the mix were wetted with the binders described in Table 2 by adding the binder by drops from an eye-dropper while continuously stirring the mix. The mix was immediately molded into uncured 17.8×1.3×2.5 cm(7×0.5×1 inch) flat wheels using a 200 ton steam press to cold press at 182 metric tons (200 tons) of pressure. Results are shown in Table 2.

Water improved wheel green strength. Mix handling quality during molding was good for all levels of water used.

Samples containing TDA were harder to handle and mold than samples containing water.

TABLE 2

| | COMPONENT | | | |
|---|---|---|---|---|
| | Coated Granular Abrasive (g) | Binder (ml) | Mix Handling | Uncured Molded Article |
| Water Binder | 450 | 1.25 | Good, compressible and free flowing | Excellent green strength & edge holding |
| | 450 | 1.50 | Good, compressible and free flowing | Excellent green strength & edge holding |
| | 450 | 2.50 | Good, compressible free-flowing | Excellent green strength & edge holding |
| | 450 | 2.50 | Good, compressible free-flowing | Excellent green strength |
| | 450 | 3.00 | Extremely wet mix, Began to agglomerate, still suitable for spreading in mold | Excellent green strength & edge holding |
| No Binder[a] | 450 | — | Difficult to compress. Free flowing. | Brittle edges; sufficient green strength to unmold. |
| TDA Binder | 450 | 1.10 | Mix did not set up. Poor binding. | Acceptable green strength, edges brittle |
| | 450 | 1.50 | Mix did not set up. Poor binding. | Acceptable green Strength, edges brittle |

[a]Could not press wheels to 12.7 mm (0.5 inch) thickness. Without binder, wheels were 13.2 mm (0.52 inches) thick at 182 metric ton pressure.

EXAMPLE 5

Commercial scale abrasive wheels were fabricated in a cold pressing operation using water as a temporary binder. The mix formulation of Example 2B was blended with water in amounts shown in Table III below. Wheels were pressed as described in Table III at ambient temperature (cold pressed).

Samples 1 and 2 were pressed into 17.8×0.8×2.5 cm (7×⅓×1 inch) wheels; Samples 3 and 4 were pressed into 91.4×10.2×50.8 cm (36×4×20 inch) wheels; and Samples 5–7 were pressed into 30.5×2.5×10.2 cm (12×1×4 inch) wheels. Results are shown in Table III.

TABLE III

| Samp. No. | Mix[a] | Water (cc) | Molding Press | Results: Uncured | Results: Cured |
|---|---|---|---|---|---|
| 1 | 1000 g | 10 | 10,000 lbs | Acceptable green strength, molded to size specification | Acceptable, no shrinkage or swelling |
| 2 | 1600 g | 16 | 10,000 lbs | Acceptable green strength, molded to size specification | Acceptable, no shrinkage or swelling |
| 3 | 120 lbs | 480 | 1800 tons | Acceptable green strength, molded to size specification | Acceptable, no shrinkage or swelling |
| 4 | 120 lbs | 600 | 1800 tons | Acceptable green strength, molded to size specification | Acceptable, no shrinkage or swelling |
| 5 | 17.2 lbs | 34 | 700–800 tons | Acceptable green strength, molded to size specification | Acceptable burst strength[c], no shrinkage or swelling |
| 6 | 18 lbs | 51 | 700–800 tons | Acceptable green strength, molded to size specification | Acceptable burst strength[c], no shrinkage or swelling |
| 7[b] | 17.5 lbs | 34 | 700–800 tons | Acceptable green strength, molded to size specification | Acceptable, burst strength[c], no shrinkage or swelling |

[a]For Samples 3 and 4, the Example 2B mix was altered to contain 36/46 grit blend abrasive grain with a minor amount of grain diluent.
[b]Curing agent (hexamethylene tetramine) was increased to yield a total curing agent amount of 9%, by weight, of total novolac resin.
[c]Burst strength was measured after a 10 day water soak. All samples had a burst strength in excess of 5360 rpm, the acceptable limit for commercial use.

Other modifications and variations of this invention are possible in view of the description thus provided. It should be understood, therefore, that changes may be made in the particular embodiments shown which are within the scope of the invention defined in the appended claims.

I claim:

1. A process for preparing a molded abrasive article, comprising the steps:

a. blending at 80° to 130° C. measured portions of a liquid phenol-novolac resin having a viscosity of 300 to 3,000 cp with an abrasive grain;

b. simultaneously adding during the blending step measured portions of powdered abrasive article bond components comprising at least one curing agent and at least one dry phenol-novolac resin to form a free flowing uniformly coated abrasive grain at room temperature;

c. mixing an effective amount of water with the free-flowing, uniformly coated abrasive grain to form a free-flowing, compressible mixture;

d. placing the free-flowing, compressible mixture into a mold having a desired shape configuration; and e. pressing the free-flowing, compressible mixture at a temperature less than 40° C. until an uncured molded abrasive article is obtained, wherein the uncured molded abrasive article has sufficient green strength to be removed intact from the mold and cured without loss of the desired shape configuration.

2. The process of claim 1, wherein 0.001 to 5 percent, by weight of water is used as a temporary binder on the uniformly coated abrasive grain.

3. The process of claim 1, wherein 0.5 to 3 percent, by weight of water is used as a temporary binder on the uniformly coated abrasive grain.

4. The process of claim 1 wherein the pressing step is carried out at 0.5 to 15 tons/square inch for 5 seconds to one minute.

5. The process of claim 1 further comprising the step of heat curing the molded abrasive article at a temperature of 150° to 250° C. for 6 to 48 hours.

* * * * *